US005600960A

United States Patent [19]

Schwedler et al.

[11] Patent Number: 5,600,960

[45] Date of Patent: Feb. 11, 1997

[54] NEAR OPTIMIZATION OF COOLING TOWER CONDENSER WATER

[75] Inventors: Michael C. A. Schwedler; Jon R. Hage; Dennis R. Dorman, all of La Crosse, Wis.; Michael J. Stiyer, New Hope, Minn.

[73] Assignee: American Standard Inc., Piscataway, N.J.

[21] Appl. No.: 563,848

[22] Filed: Nov. 28, 1995

[51] Int. Cl.[6] ..... F25D 17/02; F25B 39/04

[52] U.S. Cl. ..... 62/99; 62/185; 62/201

[58] Field of Search ..... 62/99, 183, 201, 62/185

[56] References Cited

U.S. PATENT DOCUMENTS

| | | | |
|---|---|---|---|
| 3,710,852 | 1/1973 | Porter | 165/62 |
| 4,327,559 | 5/1982 | Spethmann | 62/179 |
| 4,457,358 | 7/1984 | Kriege et al. | 165/50 |
| 4,474,027 | 10/1984 | Azmi et al. | 62/171 |
| 4,507,930 | 4/1985 | Kaya et al. | 62/129 |
| 5,040,377 | 8/1991 | Braun et al. | 62/183 |
| 5,083,438 | 1/1992 | McMullin | 62/129 |
| 5,201,648 | 4/1993 | Lakowske | 418/201 |
| 5,230,223 | 7/1993 | Hullar et al. | 62/196 |
| 5,333,469 | 8/1994 | Hullar et al. | 62/181 |
| 5,347,821 | 9/1994 | Oltman et al. | 62/84 |
| 5,355,691 | 10/1994 | Sullivan et al. | 62/201 |
| 5,396,782 | 3/1995 | Ley et al. | 62/295 |
| 5,419,146 | 5/1995 | Sibik et al. | 62/115 |

FOREIGN PATENT DOCUMENTS

| | | | |
|---|---|---|---|
| 0069956 | 6/1978 | Japan | 62/99 |

OTHER PUBLICATIONS

"*Near–Optimal Control of Cooling Towers for Chilled–Water Systems*", by J. E. Braun & G. T. Diderrich, SL–90–13–3, 1990 Part II.

"*Prehistoric Man and Centrifugal Chillers*", Trane Engineers Newsletter, vol. 19, No. 3, 1990.

"*Tower Water Temperature*", Trane Engineers Newsletter, vol. 24, No. 1, 1995.

"*Global Optimization of HVAC System Operations in Real Time*", by Z. Cumali, DA–88–23–1, From Ashrae Transactions 1988.

"*Optimizing Chiller Plant Energy Savings Using Adaptive DDC Algorithms*", by M. A. Cascia, OT–88–18–1, pp. 1937–1946.

"*Cool Plant Optimization Application Guide*", by Mark A. Cascia.

"*Cooling Towers*".

*Primary Examiner*—William E. Wayner

*Attorney, Agent, or Firm*—William J. Beres; William O'Driscoll; Peter D. Ferguson

[57] ABSTRACT

A method of minimizing energy use in a chiller and cooling tower system is disclosed. The method comprises the steps of: determining a measure of chiller efficiency; determining a measure of cooling tower efficiency; determining a measure of the transfer rate of heat energy between the cooling tower and the chiller; calculating a near optimal water temperature as a function of the chiller work efficiency, the cooling tower efficiency and the transfer rate; and operating the cooling tower to provide a conditioned fluid at the temperatures to produce near optimal energy consumption.

25 Claims, 4 Drawing Sheets

NEAR OPTIMIZATION OF COOLING TOWER CONDENSER WATER

BACKGROUND OF THE INVENTION

The present invention is directed to optimizing energy use in a chiller plant transferring heat between cooling towers and a chiller.

A chiller is an air conditioning system which provides a temperature conditioned fluid, usually water, for use in conditioning the air of a load such as a building. Chillers are typically used in large air conditioning systems which centralize the air conditioning requirements for a large building or complex of buildings by using water or a similar fluid as a safe and inexpensive temperature transport medium.

In its operation, the chiller provides conditioned water of a particular temperature for use in cooling air in a building by means of a first water loop. Heat is extracted from the building air, transferred to the water in the water loop, and is returned via the water loop to the chiller which again refrigerates the water to the desired temperature by transferring the heat of the water to the chiller's refrigerant. After the refrigerant is compressed by a compressor or absorbed in an absorber, the heat in the refrigerant is transported to the condenser and heat is transferred to a second water loop. The second water loop transports heat from the condenser of the chiller system to a cooling tower or towers which then transfers the heat from the second water loop to ambient air by direct contact between the ambient air and the water of the second loop.

In the past the water being cooled in the second water loop by the cooling towers has been cooled using one of three strategies. Since the chiller is considered the largest power consumer in the air conditioning system, a first strategy cools the water in the second water loop as cold as possible without regard to the energy used by the cooling tower fan. However, although chillers are still a significant power consumer, they are also the most efficient part of an air conditioning system. Centrifugal chillers such as those sold under the trademark CenTraVac™ by The Trane Company, a Division of American Standard Inc., are available at 0.50 kilowatts per ton at ARI rating conditions.

A second tower water temperature control strategy is to produce the warmest possible tower water to obtain a considerable reduction in tower fan energy consumption. However, operating a chiller at elevated tower water temperatures may cause adverse effects over time since the higher than normal pressure differential between the evaporator and condenser places a greater burden on the compressor.

A third strategy for operating a cooling tower is to use the wet bulb temperature plus fixed amount such as five degrees Fahrenheit. However, although tower performance is a function of ambient wet bulb temperature, tower performance is also influenced by the amount of heat being rejected, i.e. the cooling load.

The electrical energy or other energy used by the chiller in cooling the first water loop is a large source of energy usage in the chiller system and an area with potential energy savings. Additionally, since the fan power of the cooling tower fans is proportional to the airflow rate cubed, the energy used by the cooling towers in cooling the second water loop is also another area with potential energy savings by reducing energy usage.

Previously, applicant has attempted to optimize both the amount of energy used by the cooling towers and the amount of energy used by the chillers so as to thereby optimize the overall energy usage of the system. This optimal approach has proven difficult to implement due to the computer intensive calculations required. Each variable must be monitored, and the optimal temperature determined by iteration each time a variable changes.

Johnson Services company, as shown by their U.S. Pat. No. 5,040,377 to Braun et al., uses a near optimal solution where a fan control controls the speed of the cooling tower fans to minimize the total power consumption of the fan and the compressor motors. To the extent that this patent shows a cooling tower/chiller system with a unified control system, this patent is incorporated by reference herein.

Applicant considers that all of these previous approaches can be improved upon.

SUMMARY OF THE INVENTION

It is an object, feature and advantage of the present invention to provide a chiller system where the energy usage of the chiller and the cooling towers are, for practical purposes, optimized.

It is an object, feature and advantage of the present invention to determine criteria to minimize energy usage in a chiller and cooling tower system.

It is an object, feature and advantage of the present invention to determine a near optimal temperature to be maintained by the cooling towers in the fluid provided to the chiller.

It is a further object, feature and advantage of the present invention to deliberately increase the energy usage of portions of a chiller plant in order to reduce the overall consumption of energy in the chiller plant.

It is an object, feature and advantage of the present invention to minimize the ongoing energy costs of the total chiller plant.

It is a further object, feature and advantage of the present invention to provide a system control that is unavailable in the marketplace today.

It is an object, feature and advantage of the present invention to minimize the energy use of a chiller/cooling tower subsystem by minimizing the sum of the chiller plus cooling tower fan power consumption.

It is a further object, feature and advantage of the present invention to determine the optimum cooling tower fan status for a given load and a given number of on-line chillers as a function of temperature in a second water loop.

It is an object, feature and advantage of the present invention that the calculating methods used to produce the near optimal energy consumption have been simplified in such a manner as to be suitable for implementation in low power, microprocessor based control systems.

It is an object, feature and advantage of the present invention that the invention uses real-time data as inputs to the calculations so as to be readily usable by most chiller cooling tower systems, thereby continuously adjusting in response to changes in the building load and in cooling tower ambient conditions.

The present invention provides a method of minimizing energy usage in a chiller and cooling tower system. The method comprises the steps of: determining a measure of chiller efficiency; determining a measure of cooling tower efficiency; determining a measure of the transfer rate of heat energy between the cooling tower and the chiller; calculating a near optimal water temperature as a function of the chiller work efficiency, the cooling tower efficiency and the transfer rate; and operating the cooling tower to provide a conditioned fluid at the near optimal temperatures.

The present invention also contemplates that the measure of cooling tower efficiency is a function of wet bulb temperature, that the measure of chiller efficiency is a weight ratio where the weighted ratio is a function of the ratio of actual load to design load for the operating chiller or chillers, and that the measure of the transfer rate is a function of the flow rate in a second water loop interconnecting the chiller and the cooling tower.

The present invention additionally contemplates that the near optimal temperature is determined according to the formula: Near Optimal Temperature=(A1*Actual Wet Bulb Temperature)+(A2*Weighted Ratio)+A3*(Design Wet Bulb Temperature)+(A4*GPM/ton)+(A5*Steam Rate*Weighted Ratio*Electricity Cost/Steam Cost/K)+A6 where A1, A2, A3, A4, A5 and A6 are empirically determined constants.

The present invention further provides an energy efficient air conditioning system. The system includes a load; a chiller for providing a conditioned fluid to control the temperature of the load; a chiller controller operating the chiller to maximize energy efficiency for a particular load; and a cooling tower for transferring heat energy between ambient air and a heat transfer fluid. The system also includes at least one fan blowing air over the heat transfer fluid in the cooling tower; a fluid conduit carrying the heat transfer fluid and interconnecting the cooling tower and the chiller; a pump in the fluid conduit; and a sensor for sensing the temperature of the heat transfer fluid in the cooling tower. The system further includes a fluid temperature selector, responsive to the load and ambient conditions, for determining a near optimal fluid temperature for the fluid in the fluid conduit; and a cooling tower controller responsive to the fluid temperature selector and the fluid temperature sensor for operating the cooling tower to maximize energy efficiency.

The system also includes wet bulb temperature sensing devices and signal processing capabilities to process the signals received from the sensing devices.

DETAILED DESCRIPTION OF THE DRAWING

Figure 1:
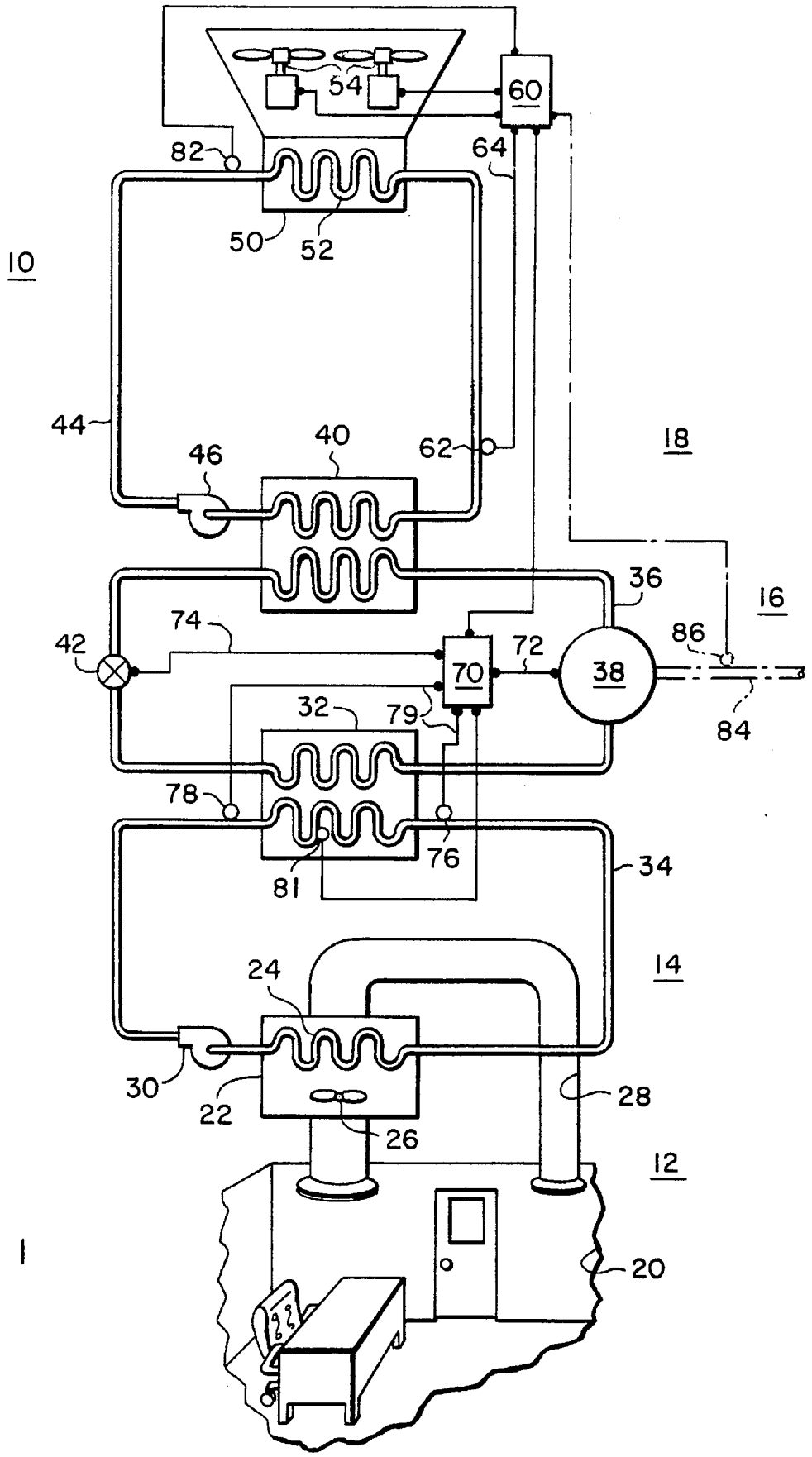
FIG. 1 is a diagram of an air conditioning system including a chiller and a cooling tower in accordance with the present invention.

FIG. 1 shows an air conditioning system 10 which includes an air side loop 12, a first water transport loop 14, a refrigeration loop 16, and a second water transport loop 18. Representative air conditioning systems 10 are sold by The Trane Company. These systems include centrifugal chiller compressor systems and related equipment sold by The Trane Company under the trademark CenTraVac and include Trane Models CVHE, CVHF and CVHG. Additionally, The Trane Company sells helirotor chiller compressor systems under the trademark Series R including Models RTHA and RTHB. Scroll chiller compressor systems are sold by The Trane Company under the trademark 3D including Model CGWD. Representative helirotor systems are described in U.S. Pat. Nos. 5,347,821 to Oltman et al. and 5,201,648 to Lakowske, both of which are assigned to the assignee of the present invention and incorporated by reference herein. Additionally, chiller systems can use nonmechanical refrigeration compressors such as one or two stage absorption machines to chill the water used by the first water loop 14. Such systems are sold by The Trane Company under the trademark Thermachill or under the Model Numbers ABSC or ABTE. A representative absorption apparatus is described in U.S. Pat. No. 3,710,852 to Porter, this patent being assigned to the assignee of the present invention and incorporated by reference herein. The Trane Company also sells suitable air handlers under the trademarks Climate Changer and Modular Climate Changer. An exemplary air handler is described in U.S. Pat. No. 5,396,782 to Ley et al., this patent being assigned to the assignee of the present invention and incorporated by reference herein.

In the air side loop 12, a load such as a space 20 to be air conditioned is cooled by an air handler 22. The air handler 22 can also be used for heating but is described in terms of a single application, cooling, for ease of explanation. The air handler 22 uses the fluid transported by the first water loop 14 to transfer heat energy from air being circulated from the space 20 by means of a fan 26 and ductwork 28 to a heat exchange coil 24 in the air handler 22.

The transport fluid in the first water loop 14 is circulated by a pump 30 between the air handler 22 and the evaporator 32 of the refrigeration system 16. The evaporator 32 conditions the transport fluid to a predetermined temperature such as 44° F. so that the fluid can be reused and transported by piping 34 to any one of various air handlers 22. The energy extracted from the transport fluid by the evaporator 32 is transported by refrigeration conduit 36 to a compressor 38 which lowers the condensation point of the refrigerant so that the refrigerant can be condensed by a condenser 40 effectively transferring energy to the second water loop 18. A metering device 42 such as an expansion valve or orifice maintains the pressure differential between the evaporator 32 and the condenser 40.

The heat of condensation in the condenser 40 is transferred to the second water loop 18 where that heat is transported by conduit 44 and a water pump 46 to at least one cooling tower 50. Suitable cooling towers are sold by Marley Cooling Tower Company under the identifiers Series 10, Series 15 and Sigma 160. The cooling tower 50 includes heat exchange surfaces 52 to transfer heat from the second water loop 18 to ambient air, and includes condenser fans 54 which move ambient air over the heat exchange surfaces 52.

A cooling tower controller 60 controls the speed and staging of the cooling tower condenser fans so as to maintain a near optimal cooling tower condenser water temperature as monitored by a sensor 62 and reported to the controller 60 by a connecting line 64. The sensor 62 can be located in the conduit 44 or in a sump or basin of the cooling tower 50. Similarly, a chiller controller 70 determines whether a chiller is on and controls the chiller operation by a connecting line 72 to the expansion valve 42. A suitable chiller controller is sold by The Trane Company under the trademark UCPII. Other suitable chiller controllers are described in U.S. Pat. Nos. 5,355,691 to Sullivan et al. and 5,419,146 to Sibik et al., these patents being assigned to the assignee of the present invention and incorporated by reference herein.

Sensors 76 and 78 are provided to monitor the leaving water temperature and the entering water temperature of the evaporator 32 respectively. Electrical lines 79 are provided to connect those sensors 76 and 78 to the controller 70. The difference (Delta T) between the leaving water temperature as measured by the sensor 76 and the entering water temperature as measured by the sensor 78 provides a measure of the actual load on any given chiller, particularly when the flow rate in the first water loop, as measured by a sensor 81 measuring the pressure drop across the evaporator, is also known. Thus actual load is a function of Delta T and the flow rate.

Figure 2:
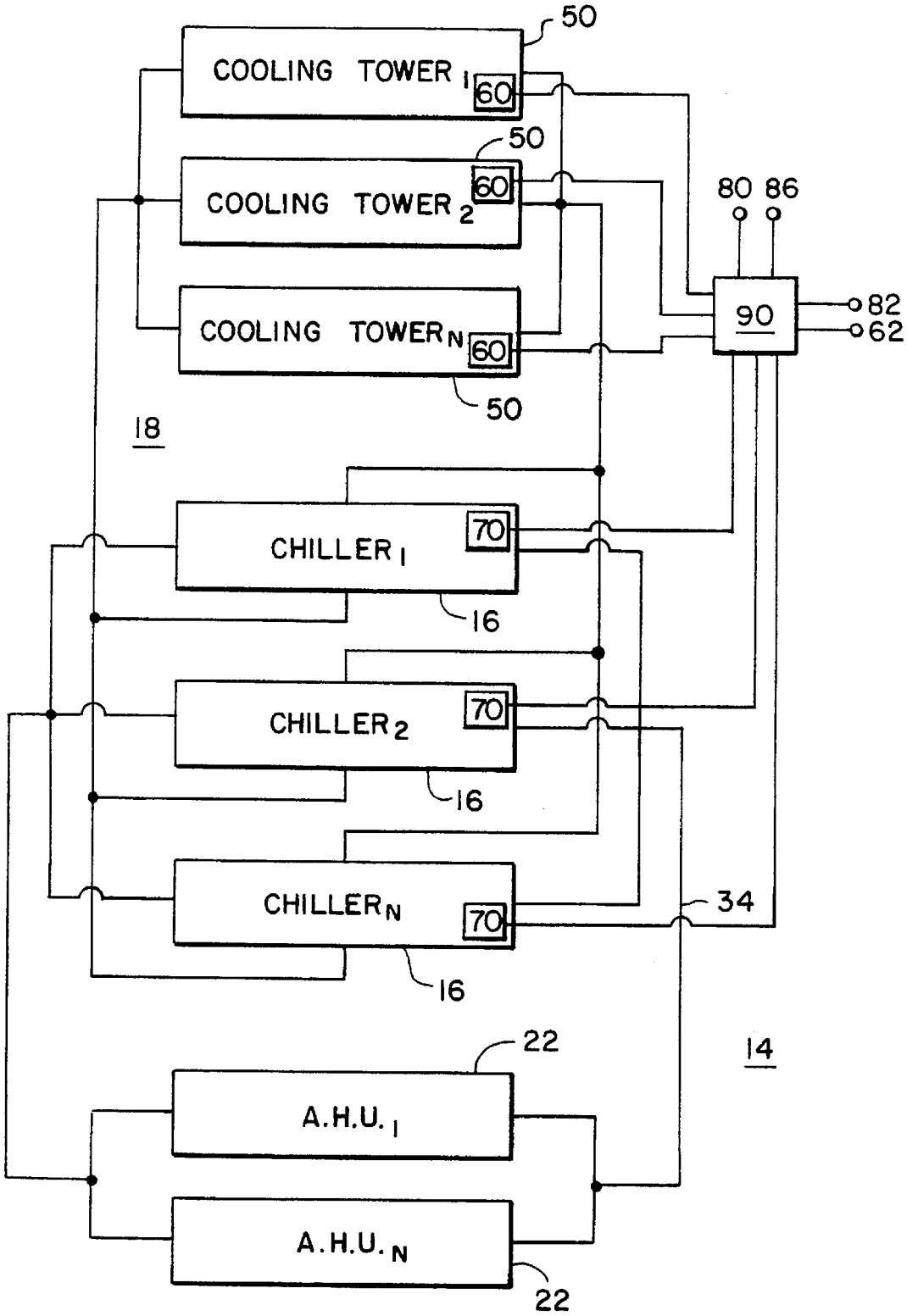
FIG. 2 is a diagram of an air conditioning system showing the parallel piping arrangements for multiple cooling towers and multiple chillers in accordance with FIG. 1.

Although there are a number of ways to accomplish the controls, applicant prefers the use of a system controller 90 overseeing and managing the individual controllers 60, 70 of each equipment group 50, 16. Such a controller 90 is sold by The Trane Company under the trademark Tracer. As shown in FIG. 2, each cooling tower 50 has an individual controller 60, and each chiller 16 has an individual controller 70. The system controller 90 is operably connected to each cooling tower controller 60 and to each chiller controller 70. Additionally, the system controller 90 can be arranged to receive the input signals from the condenser water temperature sensor 62, the wet bulb temperature sensor 80, the flow rate sensor 82 and the steam rate sensor 86 and process and forward the input signals to the controllers 60,70. For this reason, the system controller 90 includes a conventional microprocessor for undertaking the calculations described with respect to FIG. 4 and for forwarding the cooling tower setpoint to the cooling tower controllers 60 and for forwarding other information to the controller 60, 70 such as the inputs from the sensors.

With reference to FIG. 2, the terms chiller, cooling tower and air handler are used both in the singular and plural sense throughout this document. For example, FIG. 2 shows a plurality of chillers 16 piped in parallel (shown) or in series (not shown) to provide the cooling water to the first water loop 14 by means of its conduit 34. The water is provided to a plurality of air handlers 22 also piped in parallel. Similarly, the cooling towers 50 are piped in parallel in the second water loop 18 and connected in parallel with the condensers 40 of the various chillers. Thus the chiller controllers 70 and the cooling water tower controllers 50 can turn on chillers 16 as needed to meet the air handler load by maintaining a particular temperature in the first water loop 14. Similarly, the cooling tower controllers 60 can turn on cooling towers 50, stage fans 54, or vary the fan speed of the fans 54 in those cooling towers 50 to maintain a particular water temperature in the second water loop 18.

In this regard, the present invention determines a near optimal cooling tower condenser water temperature to be maintained in the second temperature loop 18. The various controllers 60 stage the fans 54, stage the cooling towers 50, and/or vary the fan speed to maintain that near optimal temperature. Meanwhile, the various chillers 16 are staged and controlled to handle the load in an energy efficient manner as possible. The operating configuration of the centrifugal chiller is most efficient when the inlet guide vane is set to some maximum open position and when the rotational speed of the impeller is set at the lowest possible speed that does not induce surge conditions.

Figure 3:
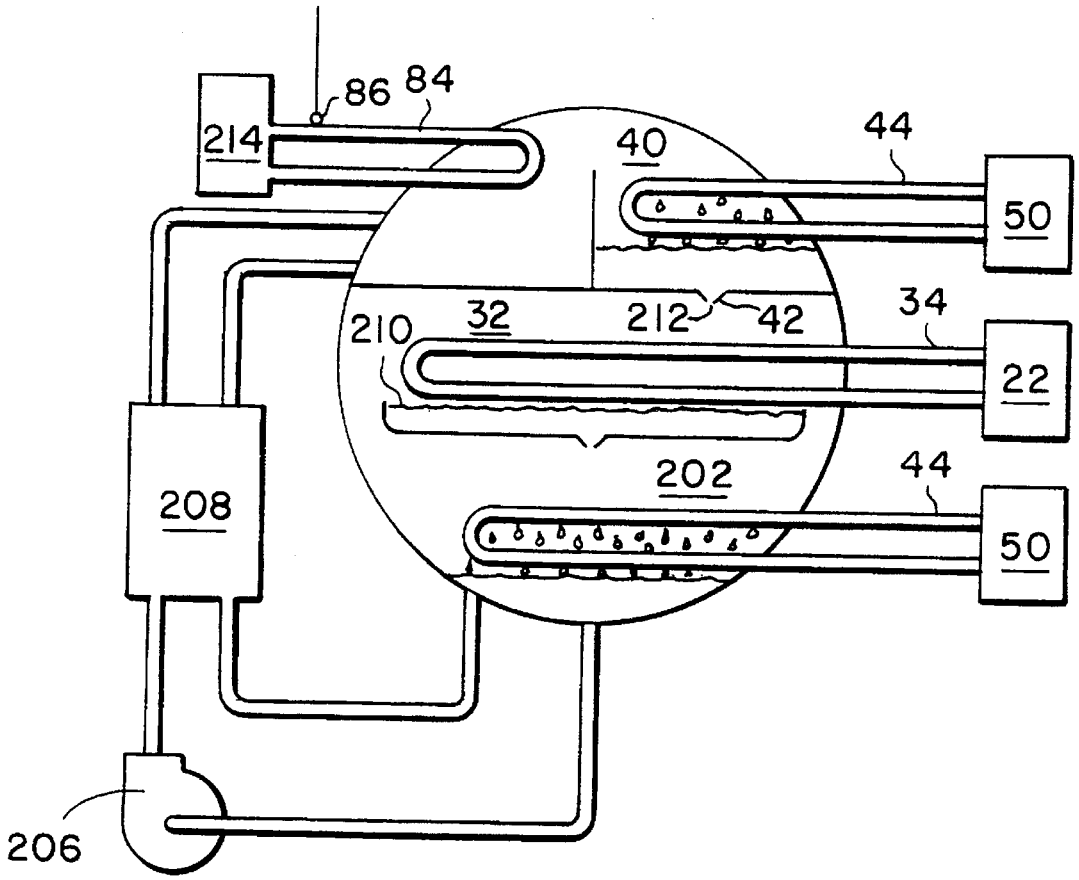
FIG. 3 is a diagram of an absorption refrigeration systems suitable for use with the present invention.

As shown in FIG. 3, an absorber 202, generator 204, pump 206 and recuperative heat exchanger 208 replace the compressor 38 in absorption refrigeration. Like mechanical refrigeration, the cycle "begins" when high-pressure liquid refrigerant from the condenser 40 passes through a metering device 42 into the lower-pressure evaporator 32, and collects in the evaporator pan or sump 210. The "flashing" that occurs at the entrance 212 to the evaporator cools the remaining liquid refrigerant. Similarly, the transfer of heat from the comparatively warm system water 34 to the now-cool refrigerant causes the refrigerant to evaporate, and the resulting refrigerant vapor migrates to a lower-pressure absorber 202. There, the refrigerant is "soaked up" by an absorbent lithium-bromide solution. This process not only creates a low-pressure area that draws a continuous flow of refrigerant vapor from the evaporator 32 to the absorber 202, but also causes the vapor to condense as the vapor releases the heat of vaporization picked up in the evaporator 32 to cooling water in the conduit 44. This heat—along with the heat of dilution produced as the refrigerant condensate mixes with the absorbent—is transferred to the cooling water in the conduit 44 and released in the cooling tower 50.

Assimilating refrigerant dilutes the lithium-bromide solution and reduces its affinity for refrigerant vapor. To sustain the refrigeration cycle, the solution must be reconcentrated. This is accomplished by constantly pumping dilute solution from the absorber 202 through the pump 206 to the generator 204, where the addition of heat from a heat source 214 such as steam boils the refrigerant from the absorbent. Once the refrigerant is removed, the reconcentrated lithium-bromide solution returns to the absorber, ready to resume the absorption process. The refrigerant vapor "liberated" in the generator 204 migrates to the condenser 40. In the condenser 40, the refrigerant returns to its liquid state as the cooling water in the conduit 44 picks up the heat of vaporization carried by the vapor and transfers it to the cooling tower 50. The liquid refrigerant's return to the metering device 42 marks the cycle's completion. Further details of absorption systems can be derived from the previously referenced U.S. Pat. No. 3,710,852 to Porter.

Figure 4:
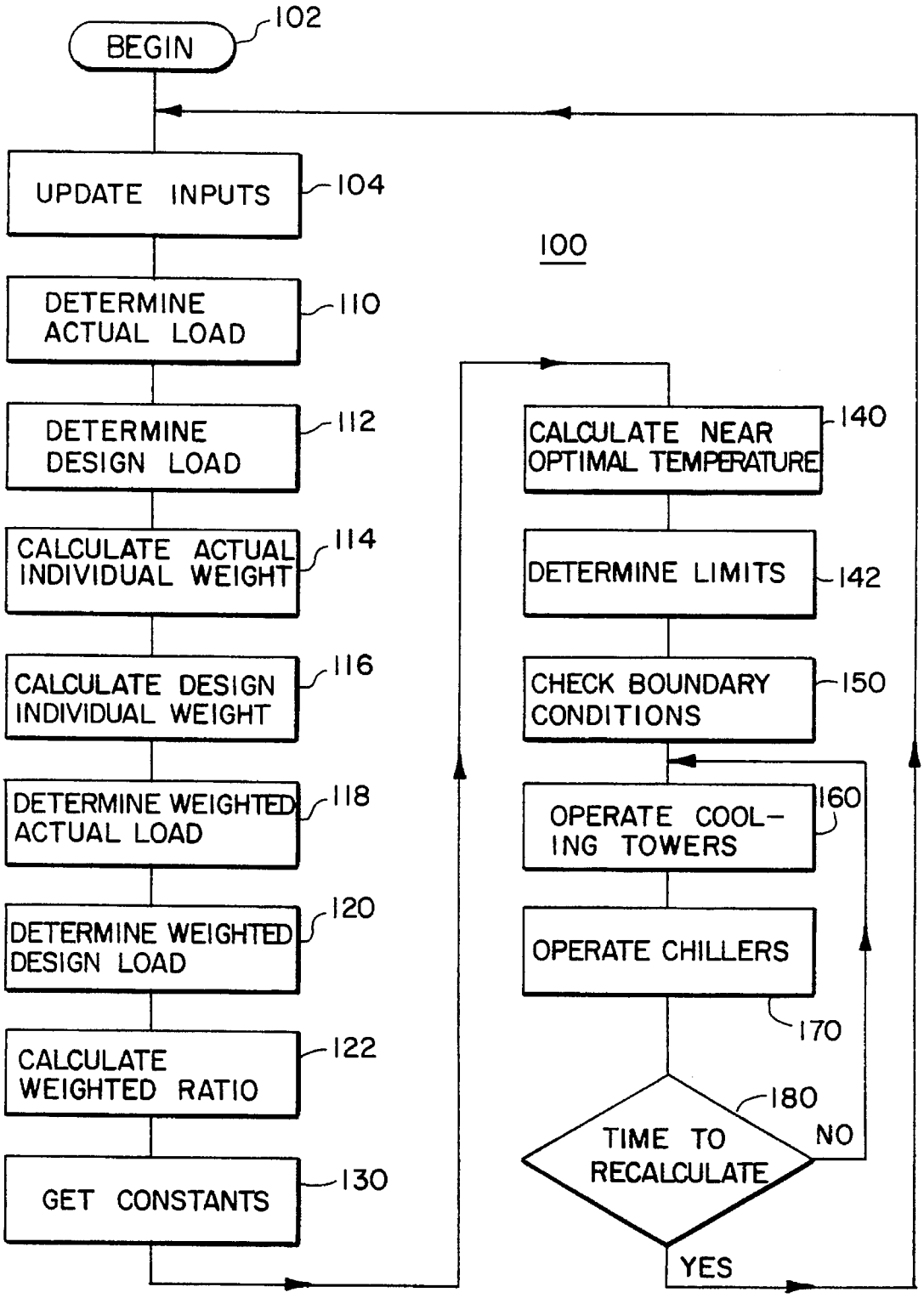
FIG. 4 is a flow chart showing the operation of the present invention.

FIG. 4 is a flow chart 100 generally explaining the operation of the air conditioning system 10 in accordance with the present invention. The flow chart commences at 102 and then proceeds to a control loop comprising steps 104 through steps 180. At step 104 the various inputs needed to calculate the near optimal cooling tower condenser water temperature are updated or determined. Design "inputs" are inputs provided to the controllers 90, 70 or 60 before the control loop is entered. Design "inputs" are essentially unchanged by the control loop, and are generally identified herein by reference to the word "design".

At step 104 the number of chillers 16 which are on is determined, the actual load in tons for each operating chiller 16 is determined and the design load in tons for each chiller operating. Additionally, the actual and design wet bulb temperatures are determined. The design conditions and the design loads are entered at system configuration and updated as necessary, while the actual wet bulb temperature is measured by a sensor such as wet bulb temperature sensor 80 connected to a cooling tower controller 60. The flow rate of the fluid in the second water loop 18 is either determined in gallons per minute per ton by a flow sensor 82 connected to a cooling tower controller 60 or determined during system installation by a system balancer and entered into the controller 60, 70, 90 as a design input. As measured by the flow rate sensor 82, the flow rate provides an indirect measure of the heat energy transfer rate between the cooling towers 50 and the second water loop 18. Rather than calculating flow rates for each unit in a multiple unit system (i.e. cooling towers or chillers), the flow rate is considered a constant for multiple chillers once the flow rate is measured by the single sensor 82 in the preferred embodiment of the present invention. Additionally, the design entering condenser water temperature is determined from previously entered data in a computer memory portion of the controller 60. If absorption chillers are used, a steam rate in a steam line 84 is determined from a steam rate sensor 86 or is entered as a design input, and an electric cost and a steam cost are determined as design inputs from previously entered data.

Once all of the updated inputs are determined at step 104, a weighted ratio is calculated at steps 110 through 122. The weighted ratio is an indication of the amount of work the operating chillers are exerting relative to their design capacity. Thus, the weighted ratio is representative of a chiller work factor.

Initially, the actual load of the operating chillers is calculated at step 110 by summing the loads of the operating chillers. For a three chiller system this sum is equal to the load on chiller 1 plus the load on chiller 2 plus the load on chiller 3. At step 112, the design load for each operating chiller 16 is similarly calculated. For a three chiller system the design load is equal to the design load of the first operating chiller plus the design load of the second operating chiller plus the design load of the third operating chiller.

Next, actual individual weights for each operating chiller for current conditions are calculated at step 114. For example, the actual individual weight for the first chiller is equal to the load on the first chiller divided by the load sum calculated above in step 110.

At step 116, a design individual weight for each operating chiller 16. For example, the design individual weight for chiller 1 is calculated as the design load of chiller 1 divided by the design sum calculated above in step 112.

Next, at step 118, the weighted actual loads are calculated by multiplying the actual loads for each operating chiller (as determined at step 110) with that chillers individual weight (as determined at step 114) and then summing the total weighted actual loads for all operating chillers. For example, in the three chiller system the weight of chiller 1 would be multiplied by the load of chiller 1 then added to the weight of chiller 2 multiplied by the load of chiller 2 and added to the weight of chiller 3 multiplied by the load of chiller 3.

At step 120, the weighted design load is calculated by multiplying the design load of each operating chiller (as determined at step 112) with that chillers design individual weight (as determined at step 116) and then summing the total weighted design loads for all operating chillers. For example, the weighted design load would be equal to the design weight of chiller 1 multiplied by the design load of chiller 1, which is added to the design weight of chiller 2 multiplied by the design load of chiller 2, and added to the design weight of chiller 3 multiplied by the design load of chiller 3.

At step 122, the weighted ratio is calculated as the ratio of the weighted actual load determined at step 118 to the weighted design load determined at step 120. If the weighted actual load was one and the weighted design load was two, the weighted ratio would be equal to one-half.

After the weighted ratio is calculated at step 122, constants specific to the operational chillers are recovered from computer memory at step 130. The efficiencies, cooling capacities, and operating characteristics of each chiller are highly dependent on the nature of the chiller itself. Centrifugal chillers are more efficient at higher tonnages than helirotor chillers, while absorption machines rely on steam, waste heat, or the like rather than electricity to generate refrigeration. Empirically determined constants for centrifugal chillers, helirotor chillers, one stage absorption and two stage absorption chillers are shown in Table 1.

TABLE 1

| Unit Type | A1 | A2 | A3 | A4 | A5 | A6 |
|---|---|---|---|---|---|---|
| Centrifugal | 0.8 | 12 | −0.290 | −0.1 | 0 | 40.33 |
| Helirotor | 0.8 | 12 | −0.270 | −0.2 | 0 | 37.00 |
| 1 Stage Absorption | 0.8 | 12 | −0.178 | −0.1 | 1 | 32.67 |
| 2 Stage Absorption | 0.8 | 12 | −0.178 | −0.1 | 1 | 34.67 |

| Unit Type | B1 | B2 | B3 |
|---|---|---|---|
| Centrifugal | 2 | 50 | 6 |
| Helirotor | 26 | 70 | 0 |
| 1 Stage Absorption | −6 | 49 | 6 |
| 2 Stage Absorption | −6 | 49 | 6 |

| Unit Type | C1 | C2 | C4 | C4 |
|---|---|---|---|---|
| Centrifugal | −15 | 2 | 10 | −1 |
| Helirotor | −15 | 2 | 10 | −1 |
| 1 Stage Absorption | −14 | 2 | 10 | −1 |
| 2 Stage Absorption | −14 | 2 | 10 | −1 |

At step 140 the near optimal temperature to be maintained in the second water loop 18 by the cooling towers 50 is calculated as a function of the chiller work factor, the cooling tower's efficiency, and the heat energy transfer rate between the cooling towers 50 and the second water loop 18. Cooling tower efficiency is determined by the latent heat in ambient air, latent heat being the difference between the wet bulb temperature measured by the sensor 70 and the design wet bulb temperature. In the preferred embodiment of the invention, the near optimal temperature is determined according to the following formula.

$$\text{Near Optimal Temperature} = (A1*\text{Actual Wet Bulb Temperature}) + (A2*\text{Weighted Ratio}) + A3*(\text{Design Wet Bulb Temperature}) + (A4*GPM/\text{ton}) + (A5*\text{Steam Rate}*\text{Weighted Ratio}*\text{Electricity Cost/Steam Cost}/K) + A6$$

Where K is a constant empirically determined to be 236 in the preferred embodiment. In this formula, A1 times Actual Wet Bulb Temperature plus A3 times Design Wet Bulb Temperature provide a measure of cooling tower efficiency. A2 times the Weighted Ratio provides a measure of chiller efficiency. A3 times Gallons per Minute (GPM) per ton provides a measure of the transfer rate of heat between the cooling towers and the chillers. A5 times the Steam Rate, the Weighted Ratio and the Ratio of Electric to Steam cost provides a compensation factor for the differing effects from absorption versus electric chillers. Since the centrifugal and helirotor chillers do not use steam, A5 is set at zero for electric chillers to delete the comparison of electric and steam costs. A6 is an empirically determined constant.

Limits are then calculated at step 142 as follows:

$$\text{Design Wet Bulb}_{min} = B1 + (B2*\text{Weighted Ratio}) + (B3*GPM/\text{Ton})$$

$$\text{Actual Wet Bulb}_{min} = C1 + (C2*\text{Design Wet Bulb}_{min}) + (C3*\text{Weighted Ratio}) + (C4*\text{ Design Wet Bulb Temperature})$$

After the limits are calculated at step 142, the boundary conditions are checked at step 150 as follows:

```
If (Weighted Ratio > 0.9) AND (Near Optimal Temperature >
        Design Entering Condenser Water Temperature +2)
        then Near Optimal Temperature = Design Entering
        Condenser Water Temperature +2
    ELSE If (Actual Wet Bulb Temperature >= Actual Wet
        Bulb_min) AND (Design Wet Bulb
        Temperature >= Design Wet Bulb_min)
      THEN Near Optimal Temperature = Near Optimal
        Temperature
            ELSE Set Near Optimal Temperature to
            MINIMUM (i.e., turn all fans on HIGH)
```

Once the boundary conditions are checked at step 150, the cooling towers are operated at step 160 so as to maintain the water in the second water loop 18 at the calculated near optimal temperature. Additionally, the chillers are operated so as to maintain a predetermined temperature in the first water loop 14 at step 170. At step 180, a check is periodically made to determine whether it is time to recalculate the near optimal temperature. If not, steps 160 and 170 are continued. If step 180 determines it is time to re-calculate the near optimal temperature then is step 104 recommenced.

A person of ordinary skill in the art will recognize that applicant's invention can be implemented on any chiller system with straightforward modifications well within that person's skill. For example, the pump 46 is preferably a single speed pump but can be modified to be a variable speed pump. In such case, a flow rate setpoint can be determined which minimizes pump energy consumption while the near optimal temperature is maintained in the second water loop 18. Effectively, a variable speed pump varies the transfer rate between the cooling tower 50 and the refrigeration loop 16. All such modifications are intended to be encompassed within the spirit and scope of the invention.

What is claimed is:

1. A method of minimizing energy usage in a chiller and cooling tower system which uses a temperature conditioned fluid to exchange heat energy between the chiller and the cooling tower system comprising the steps of:

determining a measure of chiller efficiency;

determining a measure of cooling tower efficiency;

determining a measure of the transfer rate of heat energy between the cooling tower and the chiller;

calculating a near optimal water temperature as a function of the chiller work efficiency, the cooling tower efficiency and the transfer rate; and operating the cooling tower, responsive to the near optimal water temperature, to provide the temperature conditioned fluid at the near optimal temperature.

2. The method of claim 1 including the further step of operating the chiller to operate as efficiently as possible using the conditioned fluid.

3. The method of claim 2 wherein the measure of cooling tower efficiency is wet bulb temperature.

4. The method of claim 3 wherein the measure of chiller efficiency is a weighted ratio where the weighted ratio is a function of actual load to design load for the operating chiller.

5. The method of claim 4 wherein the measure of the transfer rate is a function of the flow rate in a second water loop interconnecting the chiller and the cooling tower.

6. The method of claim 5 wherein the near optimal temperature is determined according to the formula:

Near Optimal Temperature = (*A*1*Actual Wet Bulb Temperature) + (*A*2*Weighted Ratio) + *A*3*(Design Wet Bulb Temperature) + (*A*4**GPM*/ton) + (*A*5*Steam Rate*Weighted Ratio*Electricity Cost/Steam Cost/*K*) + *A*6 where A1, A2, A3, A4, A5 and A6 are empirically determined constants.

7. The method of claim 6 including the further step of varying the transfer rate to minimize energy consumption while maintaining the near optimal temperature.

8. The method of claim 1 including the further step of varying the transfer rate to minimize energy consumption while maintaining the near optimal temperature.

9. The method of claim 1 wherein the near optimal temperature is determined according to the formula:

Near Optimal Temperature = (*A*1*Actual Wet Bulb Temperature) + (*A*2*Weighted Ratio) + *A*3*(Design Wet Bulb Temperature) + (*A*4**GPM*/ton) + (*A*5*Steam Rate*Weighted Ratio*Electricity Cost/Steam Cost/*K*) + *A*6 where A1, A2, A3, A4, A5 and A6 are empirically determined constants.

10. The method of claim 9 including the further step of compensating for steam versus electric costs whenever an absorption chiller is used.

11. The method of claim 1 wherein the measure of chiller efficiency is a weighted ratio where the weighted ratio is a function of actual load to design load for the operating chiller.

12. An energy efficient air conditioning system comprising:

a load;

a chiller for providing a conditioned fluid to control the temperature of the load;

a chiller controller operating the chiller to maximize energy efficiency for a particular load;

a cooling tower for transferring heat energy between ambient air and a heat transfer fluid;

a fluid conduit carrying the heat transfer fluid and interconnecting the cooling tower and the chiller;

a sensor for sensing the temperature of the heat transfer fluid in the cooling tower;

a fluid temperature selector, responsive to the load and ambient conditions, for determining a near optimal fluid temperature for the fluid in the fluid conduit; and a cooling tower controller responsive to the fluid temperature selector and the fluid temperature sensor for operating the cooling tower to maximize energy efficiency.

13. The system of claim 12 further including a wet bulb temperature sensor, a dry bulb temperature sensor, a chiller load sensor, and a heat transfer fluid rate sensor, all operably connected to the fluid temperature selector.

14. The system of claim 13 wherein the fluid temperature selector determines the near optimal temperature according to the following formula:

Near Optimal Temperature = (*A*1*Actual Wet Bulb Temperature) + (*A*2*Weighted Ratio) + *A*3*(Design -continued Wet Bulb Temperature) + (A4*GPM/ton) + (A5*Steam Rate*Weighted Ratio*Electricity Cost/Steam Cost/K) + A6 where A1, A2, A3, A4, A5 and A6 are predetermined constants specific to any particular chiller.

15. The system of claim 14 including circuitry or software to determine the weighted ratio as a function of actual load to design load for the operating chiller or chillers.

16. A method for minimizing ongoing energy costs for a chiller plant comprising the steps of:

determining actual and design loads for operational chillers in the chiller plant;

calculating a weighted ratio for the operative chillers;

selecting empirical constants for the operating chillers;

calculating a near optimal temperature for cooling tower condenser water;

controlling cooling tower fans to maintain the cooling tower condenser water supply at the calculated near optimal temperature; and operating the operating chillers to maximize their efficiency for user selected setpoints.

17. The method of claim 16 wherein the step of calculating the near optimal temperature includes the further steps of determining wet bulb actual and design temperatures, actual and design chiller loads, and flow rates for the condenser water.

18. The method of claim 17 where the near optimal temperature is equal to a first constant multiplied by the actual wet bulb temperature plus a second constant multiplied by a weighted load ratio minus a third constant multiplied by the design wet bulb temperature minus a fourth constant multiplied by the flow rate plus an absorption adjustment factor plus a sixth constant.

19. The method of claim 18 where the absorption adjustment factor is equal to a fifth constant multiplied by a steam rate multiplied by the weighted ratio further multiplied by the regional cost for electricity divided by the steam cost and further divided by a seventh constant.

20. A method of optimizing energy usage in an air conditioning system comprising the steps of:

calculating a near optimal condenser water temperature;

operating a cooling tower to maintain the calculated near optimal temperature;

circulating water cooled to said near optimal temperature from the cooling tower to a chiller; and operating the chiller to maintain a evaporator water temperature and to optimize the chiller energy efficiency.

21. The method of claim 20 wherein the step of calculating a near optimal condenser water temperature includes the further steps of:

determining a measure of cooling tower efficiency;

determining a measure of chiller efficiency;

determining a transfer rate between the cooling tower and the chiller; and calculating the near optimal condenser water temperature as a function of cooling tower efficiency, chiller efficiency and transfer rate.

22. The method of claim 21 where the calculations are done according to the formula:

Near Optimal Temperature = (A1*Actual Wet Bulb

Temperature) + (A2*Weighted Ratio) + A3*(Design

Wet Bulb Temperature) + (A4*GPM/ton) + (A5*Steam

Rate*Weighted Ratio*Electricity Cost/Steam Cost/K) + A6.

23. The method of claim 22 including the further step of exchanging energy between the chiller and the cooling tower condenser water at the near optimal temperature.

24. The method of claim 23 wherein the circulating step includes the step of varying a rate of circulation to minimize energy expended by the circulating step.

25. The method of claim 22 including the steps of performing the calculations using a low power microprocessor and minimizing the processing time of the microprocessor in making those calculations.

* * * * *